United States Patent [19]

Hoshino et al.

[11] Patent Number: 4,939,970

[45] Date of Patent: Jul. 10, 1990

[54] CONNECTOR FOR BODY AND NECK OF STRINGED INSTRUMENTS, LIKE GUITARS

[75] Inventors: Yoshihiro Hoshino, Nagoya; Kazuhiro Matsui, Toyoake, both of Japan

[73] Assignee: Hoshino Gakki Corporation, Japan

[21] Appl. No.: 306,510

[22] Filed: Feb. 3, 1989

[30] Foreign Application Priority Data

Jun. 15, 1988 [JP] Japan ..... 63-79123[U]

[51] Int. Cl.[5] ..... G10D 3/00

[52] U.S. Cl. ..... 84/293; 84/291

[58] Field of Search ..... 84/267, 291, 293

[56] References Cited

U.S. PATENT DOCUMENTS

| | | | |
|---|---|---|---|
| 325,067 | 8/1885 | Forrest | 84/293 |
| 3,915,049 | 10/1975 | Bean | 84/293 |
| 4,188,850 | 2/1980 | Kaman | 84/291 |
| 4,432,267 | 2/1984 | Feller | 84/293 |
| 4,793,236 | 12/1988 | McGuire et al. | 84/293 |

*Primary Examiner*—Lawrence R. Franklin

[57] ABSTRACT

A connector for joining the neck and body of a stringed instrument, like a guitar. The connector comprises a plate having upstanding flanges which are received in grooves defined in the underside of the neck and depending flanges on its underside which are received in grooves formed in the floor of the depression on the top side of the body of the instrument. A pin passes across the neck and through the neck flanges in the grooves. Screws hold the connector plate to the body and the neck.

13 Claims, 3 Drawing Sheets

CONNECTOR FOR BODY AND NECK OF STRINGED INSTRUMENTS, LIKE GUITARS

BACKGROUND OF THE INVENTION

The present invention relates to stringed instruments, and more particularly relates to a connector between the neck and the body of the instrument which integrates them and also provides an ornamental and smooth transition between the neck and the body.

In the conventional manufacture of electric guitars, and the like musical instruments, it has been customary to prepare the guitar body and the guitar neck as separate units and to unite them at the final stage of production. Ordinarily, they are bolted together with the neck screwed to the back side of the body through a joining plate. In recent years, guitars have been classified into higher, medium and lower grade guitars. In a high grade guitar, it is important to not only obtain a rigid integrated structure between the neck and the body, but also to arrange the structure of the guitar so that desirable style outlines and smoothness of design and appearance of the guitar are obtained. However, a smooth and integrated design cannot be achieved by the conventional bolted together structure which provides seams and which uses plates and connectors which interfere with the smooth flow of the external profile.

SUMMARY OF THE INVENTION

The primary object of the present invention is to connect the neck and body of a stringed instrument, and particularly a guitar neck and guitar body, to provide a smooth appearance and wherein the connection is made rigid and strong.

The invention is directed to a connector between the body and the neck of a stringed musical instrument, such as a guitar. The connector includes a plate that extends between a joining section of the neck and a joining section of the body. The connector has a neck end portion that is disposed beneath the underside of the neck and has a body end portion that is disposed above the top side of the body where the body and neck meet. There is at least one and more usually two parallel, upstanding neck flanges extending up from the neck end portion of the plate. There is also at least one and more usually two parallel, depending body flanges extending down from the body end portion of the plate. In each of the neck and the body, there are respective receiving means, in particular grooves parallel to the respective upstanding or downwardly projecting flanges, which receive those flanges. Those grooves are deep enough that the installed plate rests on the body and the neck. The plate is additionally secured to the body and the neck by appropriate securing means, such as screws.

A stringed musical instrument, such as a guitar, in which the connector is used, includes a main body having both a top side on which the connector is attached and an underside. The instrument includes a neck that is to be connected to the body at an end of the body, and the neck also has a top side and an underside, and the connector is attached at the underside of the neck.

For aesthetics and for secure mounting of the plate, the top side of the guitar body where it receives the plate has a depression for receiving the plate, and the receiving means or grooves for the flanges of the plate are defined in the floor of the depression.

For securing the plate to the neck, a pin may extend across the neck, through the neck and through the neck flanges when the neck flanges are in the receiving means grooves in the neck. An additional screw connection may hold the neck securely to the plate. The plate and its neck and body flanges are so shaped and positioned with respect to the neck and the body, and the neck and body are so shaped that the joined neck and body have a generally smooth continuous surface appearance where they meet, and that appearance is not disturbed by the plate.

Other objects and features of the present invention will become apparent from the following description of a preferred embodiment of the invention considered in conjunction with the accompanying drawings.

DESCRIPTION OF THE PREFERRED EMBODIMENT

Figure 1:
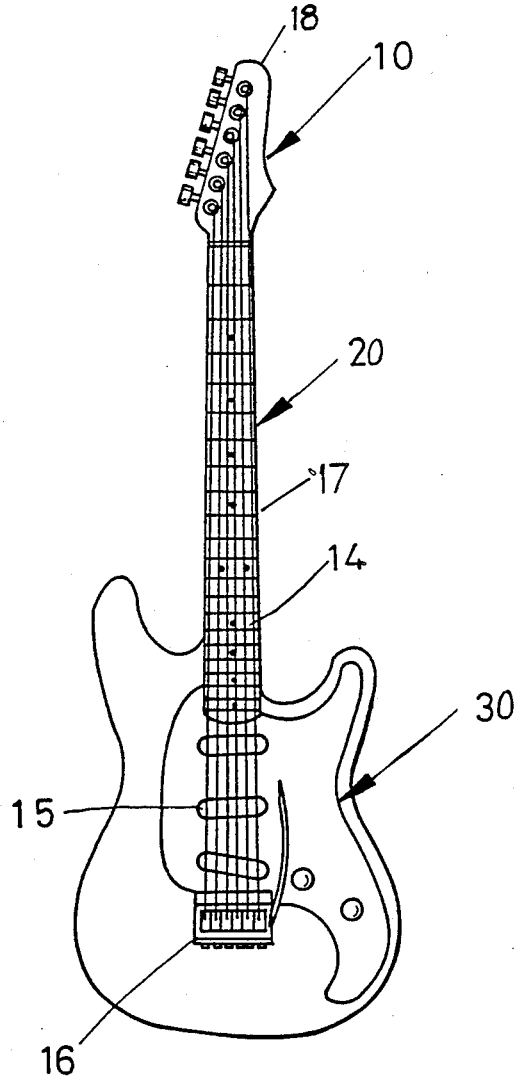
FIG. 1 is a view in perspective of an electric guitar which has a joint between the guitar neck and the guitar body according to the present invention.

The invention may be applied to any stringed instrument, such as a guitar. A guitar having the connector of the invention includes a guitar body 30 and a guitar neck 20 to be joined to the body. The neck has a finger plate applied over its top surface. A bridge 16 is supported on the guitar body. Strings 17 extend from the peg head 18 at the top of the neck to the bridge 16 located toward the bottom of the guitar body. Curved receptacles are defined in the top of the guitar body to receive conventional guitar pickups. The joint of the neck 20 and the guitar body 30 is provided by a connector 40 according to the invention.

Figure 2:
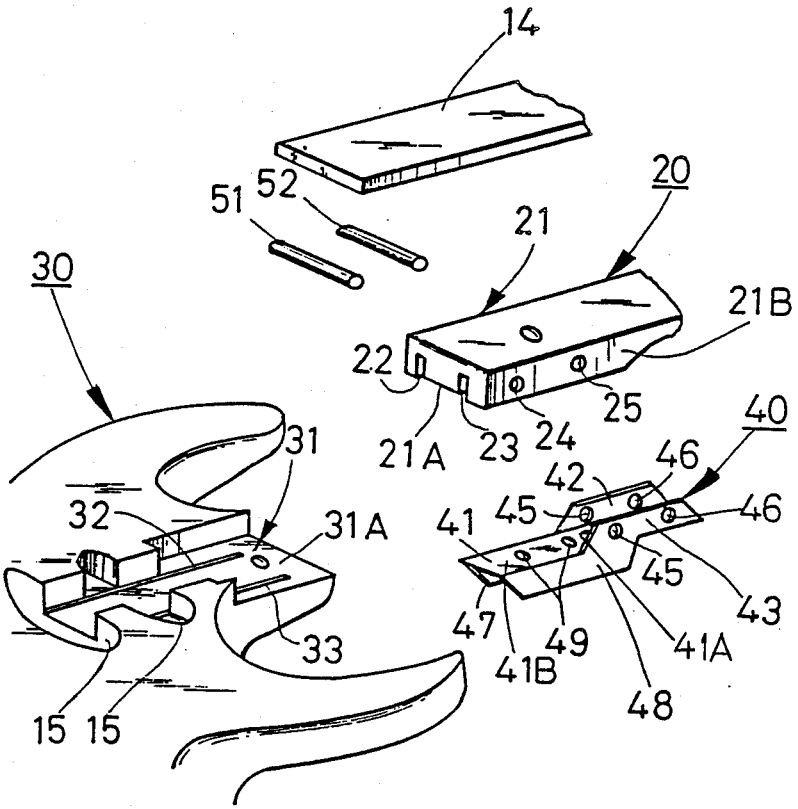
FIG. 2 is an exploded view in perspective of the joint.
Figure 3:
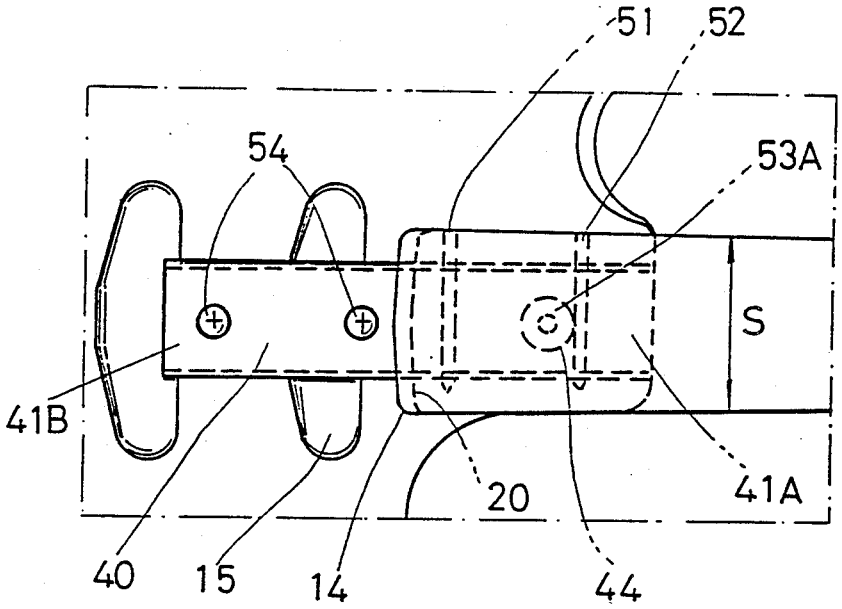
FIG. 3 is a top view of the joint showing some of the in ing elements of FIG. 2.

The neck 20 has a joining section 21 at the right center of FIG. 2. Two parallel, slit-like, neck side receiving means in the form of insertion grooves 22 and 23, extend parallel to each other along the longitudinal direction on the lower side 21A of neck joining section 21. At the lateral sides 21B of the neck joining section 21, there are two pin installation holes 24 and 25 which cross the insertion grooves 22 and 23 at right angles.

The top surface of the guitar body 30 has a joining part 31 which is shaped to receive the guitar neck 20. The upper part surface 31A of the joining part 31 has two parallel, body side insertion grooves 32 and 33 extending along the longitudinal direction.

A connector 40 has a main plate 41, preferably made of metal. The horizontal surface 41A of the main plate 41 near to the neck defines a neck end portion of the connector. That portion has a vertical installation hole 44 (FIG. 4) for a neck attachment screw 53.

The plate 41 includes two parallel, upwardly turned, side insertion flanges 42 and 43 along both sides of the horizontal surface 41A. The insertion flanges 42 and 43 are to be inserted into the neck side insertion grooves 22 and 23 that are formed in the joining portion of the neck 20. The insertion flanges 42, 43 are provided with pin insertion holes 45, 46 at positions which correspond to the pin installation holes 24 and 25 of the neck 20.

Installation holes 49 for the body side installation screws are formed on the horizontal surface 41B of the plate 41 of the connective member 40. Surface 41B defines a body end portion of the connector. On both sides of the horizontal surface 41B, there are two, parallel, depending, lower side insertion flanges 47 and 48, which are to be inserted into the body side insertion grooves 32 and 33 in the joining portion of the upper surface 31A of the guitar body.

To join the guitar neck 20 and the guitar body 30, the upwardly directly insertion flanges 42 and 43 of the connector 40 are inserted into and fixed inside the neck side insertion grooves 22 and 23. Then the cross pins 51 and 52 are passed from the pin insertion holes 24 and 25 on one side of the neck 20 through the insertion holes 45 and 46 in the flanges of the connector 40 then in the grooves. Finally, the cross pins are inserted into the other pin insertion holes.

It is desirable to insert the two cross pins 51 and 52 from the side of the neck part 21 which is adjacent to the connective part wall 31 of the body with the pin heads being covered. In addition, it is preferable for appearance for the pins to be slightly shorter than the width S of the neck 20. In addition, fixing of the insertion flanges and of the inserted cross pins can be made firmer by the simultaneous use of an adhesive.

Following this, the lower side insertion flanges 47 and 48 of the connector 40 are inserted into and fixed inside the body side insertion grooves 32 and 33. Then the neck side installation screw 53 is screwed into the installation hole 44 in the surface 41A and form the upper surface there of the guitar 30.

Figure 4:
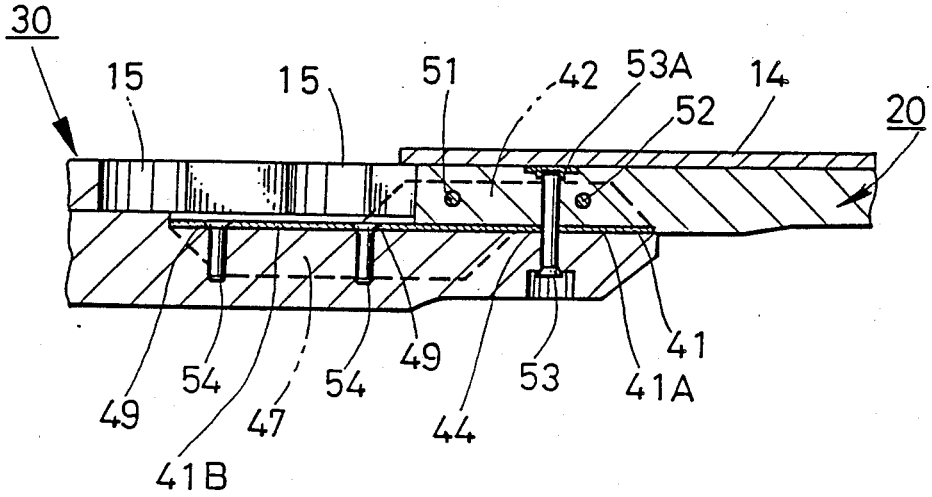
FIG. 4 is an elevational cross-sectional view taken along the longitudinal axis of the joint at the neck and body along the center of FIG. 3.

The body side installation screws 54 are screwed into the installation holes 49 of the neck side part 41B of the connector. In FIG. 4, the neck side installation screw 53 is tightened up to the nut 53A, which has been placed around the upper portion of the neck 20 for supporting the neck plate from below. Thereafter, finger board or plate 14 is pasted on the upper surface of the neck 20. The guitar pickups 15 and the bridge 16 are installed on the guitar body 30. Finishing touches are then provided. The flanges 42 and 43 and their grooves 22 and 23 and the flanges 47 and 48 and their grooves 32 and 33 are respectively so shaped and sized that the plate 41 lays against the body and the neck with the flanges installed in their grooves. This enables the guitar, the neck and their joint to have a smooth continuous surface appearance.

The joint structure between the neck and the body in a stringed instrument, like a guitar, manufactured according to this invention has a compact structure, as compared with the conventional bolted on structure since the connector is embedded in a receptacle in the guitar body and also in the neck. It is also possible to cover all of the exposed ends of the pins and screws, which markedly improves the appearance of the guitar. In addition, the neck and the guitar body can be firmly and accurately joined together by means of cross pins that cross at a right angle to the connector and to the installation screws that are installed in the vertical direction.

In the foregoing, the present invention has been described solely in connection with a preferred illustrative embodiment. Since many variations and modifications of the present invention will now be obvious to those skilled in the art, it is preferred that the scope of this invention be determined not by the specific disclosures herein contained but only by the appended claims.

What is claimed is:

1. A connector for connecting the body and the neck of a stringed instrument, the combination comprising:

a plate having a neck end portion that is disposed beneath the neck of the instrument, the plate having a body end portion that is disposed above the body of the instrument; and a neck flange extending up from the neck end portion of the plate, said neck flange extending into and connected to the underside of the neck; and a body flange extending down from the body end portion of the plate, said body flange extending into and connected to the top side of the body.

2. The connector of claim 1, wherein the neck flange and the body flange each extend in the longitudinal direction between the neck and the body.

3. The connector of claim 1, wherein there are plurality of the neck flanges and there are a plurality of the body flanges on the plate.

4. The connector of claim 3, further comprising holes in the connector for receiving securing means for securing the connector to the neck and to the body.

5. A stringed musical instrument comprising an instrument body having a top side and an underside; a neck connected to the body, and the neck having a top side and an underside; means for attaching instrument strings between the neck and the body;

a connector between the instrument body and the instrument neck, the connector comprising:

a plate having a neck end portion that is disposed beneath the underside of the neck, the plate having a body end portion that is disposed above the top side of the body;

a neck flange extending up from the neck end portion, and first receiving means in the underside of the neck for receiving the neck flange;

a body flange extending down from the body end portion of the plate, and second receiving means in the top side of the body for receiving the body flange;

the neck flange and the body flange each extending in the longitudinal direction between the neck and the body.

6. The instrument of claim 5, wherein the body flange receiving means comprises a respective groove for the body flange in the top of the body and the neck flange receiving means comprises a respective groove for the neck flange in the underside of the neck.

7. The instrument of claim 6, wherein the receiving means grooves are of such depths and the flanges are of such heights that the plate from which the flanges project lays against the top side of the body and against the underside of the neck.

8. The instrument of claim 7, further comprising a depression in the top side of the body into which the plate is disposed, and the depression having a bottom in which the groove for the body flange is defined.

9. The instrument of claim 6, further comprising body securing means securing the plate to the body, and neck securing means securing the plate to the neck.

10. The instrument of claim 9, wherein the neck securing means comprises a pin extending across the neck, through the neck, and through the neck flange in the receiving means groove in the neck.

11. The instrument of claim 10, wherein the neck securing means further comprises a screw connection extending up from below the plate and into the neck.

12. The instrument of claim 10, wherein the body securing means further comprises a screw connection extending down through the plate and into the body.

13. The instrument of claim 7, wherein the plate and the flanges are so shaped and positioned with respect to the neck and the body, that the neck and the body have a generally smooth and continuous surface where they meet.

* * * * *